US010067469B2

(12) United States Patent
Imamiya

(10) Patent No.: US 10,067,469 B2
(45) Date of Patent: Sep. 4, 2018

(54) IMAGE FORMING APPARATUS USING HUMIDITY AND TEMPERATURE DETECTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Koji Imamiya, Kawasaki Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 15 days.

(21) Appl. No.: 15/446,351

(22) Filed: Mar. 1, 2017

(65) Prior Publication Data

US 2017/0364026 A1 Dec. 21, 2017

(30) Foreign Application Priority Data

Jun. 21, 2016 (JP) ..... 2016-122560

(51) Int. Cl.
*G03G 15/00* (2006.01)
*G03G 21/20* (2006.01)
*G03G 15/20* (2006.01)

(52) U.S. Cl.
CPC ..... *G03G 21/20* (2013.01); *G03G 15/2039* (2013.01)

(58) Field of Classification Search
USPC ... 399/38, 44, 48, 53, 55, 56, 91, 94, 96, 97
See application file for complete search history.

(56) References Cited

U.S. PATENT DOCUMENTS 5,852,756 A * 12/1998 Teranishi ..... G03G 15/50 399/44
6,463,226 B2 * 10/2002 Kitajima ..... G03G 15/5033 399/44
7,177,559 B2 * 2/2007 Inoue ..... G03G 15/2039 399/44

(Continued)

FOREIGN PATENT DOCUMENTS

WO 2015/034028 3/2015

OTHER PUBLICATIONS

Extended European Search Report for European Patent Application No. 17161860.6 dated Sep. 27, 2017.

*Primary Examiner* — Hoan Tran
(74) *Attorney, Agent, or Firm* — Amin, Turocy & Watson LLP

(57) ABSTRACT

The image forming apparatus of the present embodiment has two limiters composed of a conventional high order limiter and a low order limiter, and carries out control to switch the limiter according to a temperature and a humidity so as not to reach a image contrast potential equal to or greater than those limiters. Carrier development can occur if image formation is performed in a state where the image contrast potential is high. Therefore, by providing a low order limiter as in the present embodiment and carrying out control so as not to exceed the low order limiter at the time of the image formation, an occurrence of the carrier development can be suppressed, and an image density can also be within a prescribed range.

20 Claims, 3 Drawing Sheets

(56) References Cited

U.S. PATENT DOCUMENTS

| | | | | |
|---|---|---|---|---|
| 8,699,898 | B2 * | 4/2014 | Kikuchi | G03G 15/161 399/101 |
| 9,632,461 | B2 * | 4/2017 | Sugiura | G03G 15/1665 |
| 2008/0008483 | A1 | 1/2008 | Hamaya et al. | |
| 2011/0064430 | A1 | 3/2011 | Mitamura et al. | |

* cited by examiner

| IMAGE CONTRAST LIMIT(V) COMMON FOR Y, M, C, K | RELATIVE HUMIDITY IN APPARATUS | | | | |
|---|---|---|---|---|---|
| THERMISTOR DETECTED TEMPERATURE IN APPARATUS | <20%RH | 20≦ <35 | 35≦ <55 | 55≦ <75 | 75≦ |
| | FIRST DIVISION | SECOND DIVISION | THIRD DIVISION | FOURTH DIVISION | FIFTH DIVISION |
| <42℃ | 700 | 700 | 700 | 700 | 350 |
| 42℃≦ | 700 | 700 | 700 | 350 | 350 |

IMAGE FORMING APPARATUS USING HUMIDITY AND TEMPERATURE DETECTION

CROSS-REFERENCE TO RELATED APPLICATIONS

This application is based upon and claims the benefit of priority from Japanese Patent Application No. 2016-122560, filed Jun. 21, 2016, the entire contents of which are incorporated herein by reference.

FIELD

Embodiments described herein relate generally to an electrophotographic system image forming apparatus and methods associated therewith.

BACKGROUND

Conventionally, an image forming apparatus such as a color multi-function peripheral adjusts an output density at the time of executing a printing processing to a specified number of sheets to stabilize an image density.

The image forming apparatus carries out an image quality adjustment before an image formation, forms, and then develops a specific latent image on a photoconductor to measure a density (adhesion amount) on a transfer belt. According to an obtained measured result, development conditions such as image contrast potential, charging bias voltage, exposure intensity, and the like, which are factors for determining quality at the time of development, are optimized. The image forming apparatus carries out the printing processing under the optimized development conditions.

Japanese Unexamined Patent Application Publication No. 2011-065158 is disclosed.

DETAILED DESCRIPTION

Figure 1:
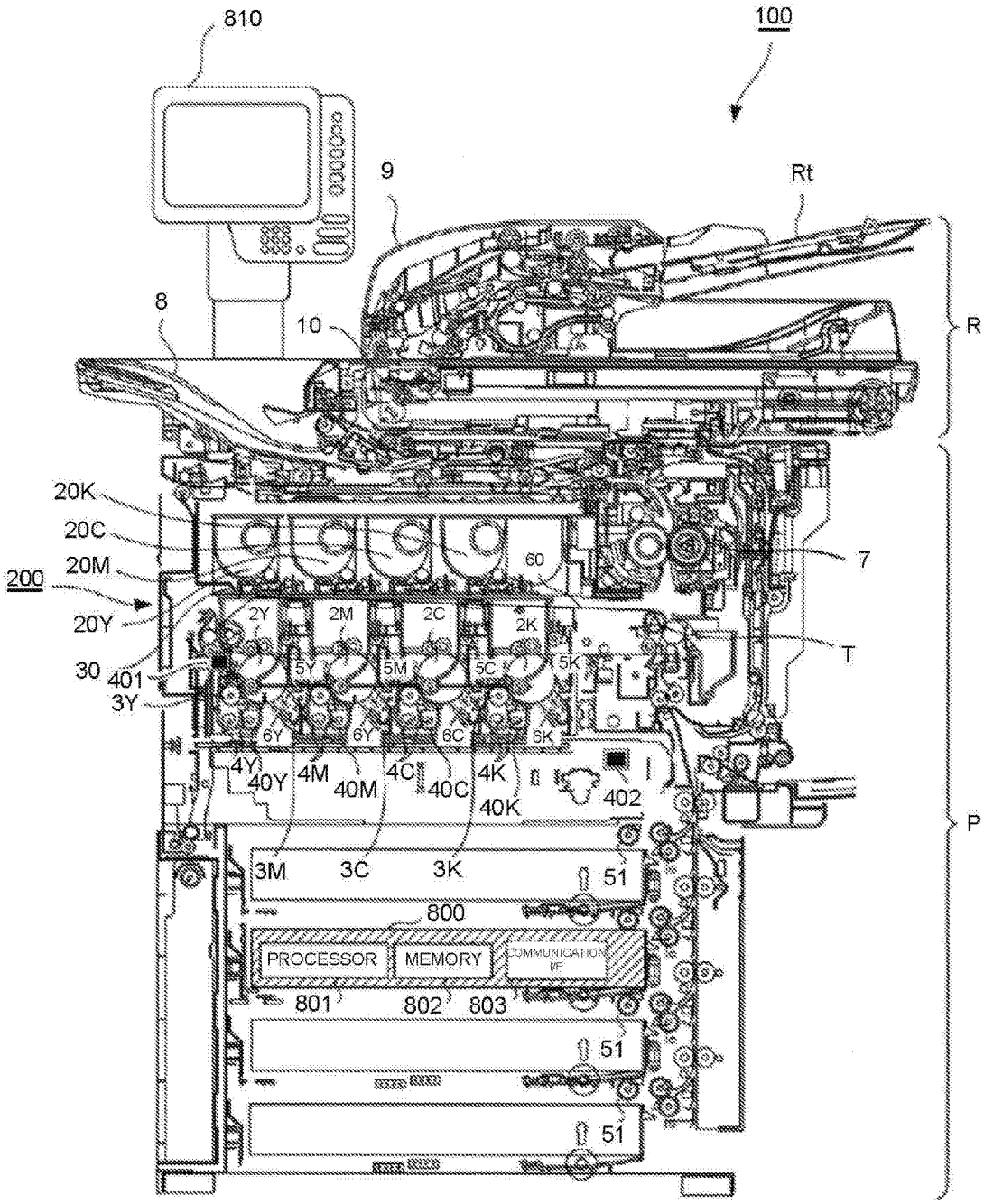
FIG. 1 is a pattern diagram of an image forming apparatus according to an embodiment.

In accordance with an embodiment, an image forming apparatus comprises an image forming unit, a toner cartridge, a humidity detection section, a temperature detection section and a controller. The image forming unit has a developing device which develops an image with a two-component developing agent to form an image. The toner cartridge supplies a toner of which a glass transition temperature is equal to or smaller than about 50 degrees centigrade to the developing device. The humidity detection section detects a humidity of the inside or outside of the image forming apparatus. The temperature detection section detects a temperature of the inside or outside of the image forming unit. The controller compares a temperature value detected by the temperature detection section with a first temperature threshold value previously set and compares a humidity value detected by the humidity detection section with a first humidity threshold value previously set. The controller switches an upper limit value of a first development condition which is one of development conditions from a first value to a second value smaller than the first value in a case in which both the temperature value and the humidity value are equal to or greater than the threshold values thereof to carry out control to form an image in such a manner that the upper limit value of the first development condition is not more than the second value.

The image forming apparatus of the embodiment uses a two-component developing agent using toner with a glass transition temperature Tg thereof equal to or smaller than about 50 degrees centigrade corresponding to a low temperature fixing. Although the glass transition temperature Tg of the conventional normal toner is about 65 degrees centigrade, the toner for low temperature fixing of the present embodiment is set to about 50 degrees centigrade or lower, and more specifically, about 40 degrees centigrade to about 41 degrees centigrade. In another embodiment, the toner for low temperature fixing of the present embodiment is about 45 degrees centigrade or lower.

The image forming apparatus has a module of detecting a humidity of a part of atmosphere inside the apparatus or the atmosphere outside the apparatus (outer air of the image forming apparatus), and a module of detecting a temperature of a part of an atmosphere inside an image forming unit or the atmosphere outside the image forming unit (outer air of the image forming apparatus). The image forming apparatus compares a temperature detected by the temperature detection module with a temperature threshold value previously set, and compares a relative humidity detected by the humidity detection module with a threshold value previously set. The image forming apparatus switches a limiter of at least one of development conditions to a limiter with lower order according to a comparison result between the temperature and the threshold value and a comparison result between the relative humidity and the threshold value. As the development conditions, there is an image contrast potential, a charging bias voltage, an exposure intensity; however, in the present embodiment, the image contrast potential which is one of them is described in detail.

The image forming apparatus of the present embodiment has two limiters composed of a conventional high order limiter and a low order limiter, and carries out control to switch the limiter according to the temperature and the humidity so as not to reach the image contrast potential equal to or greater than those limiters. Carrier development can occur if image formation is performed in a state where the image contrast potential is high. Therefore, by providing a low order limiter as in the present embodiment and carrying out control so as not to exceed the low order limiter at the time of the image formation, the occurrence of the carrier development can be suppressed, and the image density can also be within a prescribed range.

In the form of the present embodiment, the above temperature threshold value is set to a temperature higher than the glass transition temperature Tg of the toner. Further, in the form of the present embodiment, the above threshold value of the relative humidity is set to a humidity higher than 50% RH.

In the present embodiment, the image contrast potential refers to a potential difference between a DC component of a developing bias and a potential after exposure. The image contrast potential is abbreviated as Vc as necessary. If the image contrast potential (Vc) is high, the ability to transfer the toner to the photoconductor increases and the toner adhesion amount increases.

Hereinafter, the present embodiment is described with reference to the accompanying drawings.

FIG. 1 is a vertical section view illustrating the schematic constitution of an image forming apparatus 100 (Multi-Function Peripheral) according to the embodiment. As shown in FIG. 1, the image forming apparatus 100 includes a reading section R and a printing section P.

The reading section R has a function of scanning an image of a sheet document and a book document to read the image. The reading section R includes a scanning optical system 10 including a plurality of reflecting mirrors and image pickup elements, and includes an automatic document feeder (ADF) 9 capable of automatically conveying a document to a predetermined placement position. An image of a document placed on the document tray Rt and automatically conveyed by the automatic document feeder 9 and an image of the document placed on a document table (not shown) are read by the scanning optical system 10.

The printing section P forms a developing agent image on a sheet based on the image read from a document by the reading section R and image data transmitted from an external device. The printing section P includes photoconductors 2Y~2K, developing devices 40Y~40K, an intermediate transfer belt 60, a fixing device 7, a discharge tray 8, toner cartridges 20Y~20K, and a cartridge housing section 30. The developing devices 40Y~40K include developing rollers 3Y~3K, mixers 4Y~4K, electrostatic chargers 5Y~5K, and laser exposure devices 6Y~6K. The toner cartridges 20Y~20K stores toner for low temperature fixing with Tg thereof about 40 degrees centigrade~41 degrees centigrade (in other words, about 50 degrees centigrade or lower).

The image forming apparatus 100 has a controller 800. The controller 800 is a board having a processor 801, a memory 802, and a communication I/F 803 (Interface). For example, the processor 801 is an arithmetic processing device such as a CPU (Central Processing Unit), an MPU (Micro Processing Unit), etc. The processor 801 has a function of executing various processing in the image forming apparatus 100 and realizes various functions by loading a program stored in the memory 802 in advance to execute it.

The memory 802 is a storage section constituted by a nonvolatile storage device such as a RAM (Random Access Memory) which is a main storage device, a flash memory, a hard disk drive or the like. Numeric data described later, threshold values for determination, values indicating a range such as an upper limit value and lower limit value for the control are stored in advance in the memory 802. The communication I/F 803 is a unit that controls data transmission and reception to and from an external device.

The image forming apparatus 100 has a control panel 810. The control panel 810 includes a touch panel type input section for receiving an instruction from a user, and a flat type display section for displaying a preview image before the printing and displaying a processing content and a message to the user.

The image forming apparatus 100 has a temperature sensor 401 and a humidity sensor 402. The temperature sensor 401 detects a temperature of the inside or in the vicinity of the outside of an image forming unit 200 having the photoconductors 2Y~2K, the developing devices 40Y~40K, the intermediate transfer belt 60, the electrostatic chargers 5Y~5K and the laser exposure devices 6Y~6K. The humidity sensor 402 detects a relative humidity of the inside or the outside of the image forming apparatus 100. One temperature sensor 401 and one humidity sensor 402 are set in the present embodiment; however, a plurality of the temperature sensors 401 and the humidity sensors 402 may be installed for each photoconductor of each color. A temperature value and a humidity value respectively detected by the temperature sensor 401 and the humidity sensor 402 are output to the controller 800.

Hereinafter, an outline of a copy processing is described as an example of the processing by the image forming apparatus 100.

A sheet picked up by a pickup roller 51 is supplied to a sheet conveyance path. The sheet supplied to the conveyance path is conveyed to a predetermined conveyance direction by a plurality of rollers.

The images of a plurality of sheet documents continuously automatically conveyed by the automatic document conveyance device 9 are read by the scanning optical system 10.

The controller 800 carries out a predetermined image processing to the image data read from the document by the reading section R. The controller 800 controls output of electrostatic chargers 5Y~5K to charge photoconductive surfaces of the photoconductors 2Y~2K. The controller 800 controls the output of the electrostatic chargers 5Y~5K based on the image contrast potential and a charging bias voltage that are previously set or changed by a control described later. The controller 800 controls the laser exposure devices 6Y~6K to form an electrostatic latent image of the image data on the photoconductive surfaces of the photoconductors 2Y~2K. The controller 800 controls output of the laser exposure devices 6Y~6K so as to reach an exposure intensity that is previously set or changed by a control described later. In this way, electrostatic latent images of the image data read by the reading section R are formed on the photoconductive surfaces of the photoconductors 2Y, 2M, 2C and 2K for transferring developing agent images of Y (yellow), M (magenta), C (cyan) and K (black).

The developing devices 40 Y~40 K house a two-component developing agent formed by toner and carrier, and the mixers 4Y~4K stir the two-component developing agent to attach the toner to the carrier. The carrier to which the toner is attached is drawn to developing rollers (so-called magnet rollers) 3Y~3K to be absorbed. Thereafter, as an original operation, the toner is supplied onto the photoconductors 2Y~2K on which electrostatic latent images are formed, and the carrier returns to the developing devices 40Y~40K. In this way, the electrostatic latent images formed on the photosensitive surfaces of the photoconductors are developed.

In this way, toner images formed on the photoconductors 2Y~2K are transferred onto a belt surface of the intermediate transfer belt 60 (so-called primary transfer). The toner image is conveyed by the rotation of the intermediate transfer belt 60 to be transferred onto a conveyed sheet at a predetermined secondary transfer position T.

The toner image transferred onto the sheet is fixed by being heated and pressurized by the fixing device 7, and the sheet is conveyed in the conveyance path by a plurality of conveyance roller pairs to be sequentially discharged on the discharge tray 8.

The printing processing has the same operations as the foregoing operations except that the data which is a printed object transmitted from a computer is acquired via the communication I/F 803. An adjustment of the image density is executed by forming a prescribed mark or solid image on the photoconductors 2Y~2K with the above method and measuring the mark or the solid image with a density sensor.

Hereinafter, according to the temperature and the relative humidity detected by the sensors 401 and 402, an example in which the upper limit value (limit value) of the image contrast potential is changed by the controller 800 is described, and first, study matters and a study result at the time of defining the upper limit value are described. In the present embodiment, the following four patterns are studied. Further, the following each pattern is executed under an external environment of 30 degrees centigrade and 85% RH (relative humidity). The condition is referred to as an HH environment. Further, those numeric values are examples and are different depending on a type and an individual state of the image forming apparatus and installation position of each sensor.

(First Pattern) A simplex printing with a printing rate of 1% is continuously executed for 10,000 sheets. If the continuous printing is executed under the HH environment, the temperature in the image forming apparatus 100 rises and a drum thermistor temperature reaches 45 degrees centigrade. The relative humidity in the image forming apparatus 100 reduces to 55% RH due to influence of temperature rise. In the present situation, Vc upper limit adhesion (limit value: 700 V) occurs in the magenta and the black, and the carrier development occurs in the magenta and the black. Further, the upper limit adhesion refers to a state in which Vc is always maintained at the limit value in the present example. It is difficult for the toner of which the developing capacity is low to reach a desired density (adhesion amount) even if the image contrast potential is increased. At the time of adjusting the density, in order to carry out control so as to reach a desired density as much as possible, the conventional controller controls in such a manner that Vc becomes 700 V which is the limit value, and as a result, the state is maintained. Thus, the upper limit adhesion occurs. If the upper limit adhesion occurs, the image is formed in a state in which the image contrast potential is high, and the carrier development occurs as above.

(Second Pattern) A simplex printing with a printing rate of 4% is executed for 10,000 sheets. If the continuous printing is executed under the HH environment, the drum thermistor temperature reaches 41 degrees centigrade, and the relative humidity becomes 62% RH. In the present situation, Vc adhesion does not occur, and the carrier development also does not occur.

(Third Pattern) a simplex printing with a printing rate of 1% is executed for 10,000 sheets following the second pattern. If the continuous printing is executed under the HH environment, the drum thermistor temperature reaches 45 degrees centigrade, and the relative humidity becomes 77% RH. In the present situation, the Vc upper limit adhesion (700 V) occurs in the magenta and the black, and the carrier development also occurs in the magenta and the black.

(Fourth Pattern) a duplex printing with a printing rate of 3% is executed for 10,000 sheets. If the continuous printing is executed under the HH environment, the drum thermistor temperature reaches 44 degrees centigrade, and the relative humidity becomes 81% RH. In the present situation, Vc adhesion does not occur, and the carrier development also does not occur.

At the time the printing rate is 1%, as shown in the foregoing first and third patterns, Vc adhesion occurs and the carrier development occurs. At the time the printing rate is 1%, the replacement of the toner in about 400 g of the developing agent is small, even if the printing is executed on 10,000 sheets, about half toner (about 20 g) is continuously stirred in the developing device from the start. Thus, external additives on the surface of the toner are buried or disengaged and the developing capability to the photoconductor is reduced. Therefore, even if the controller raises the image contrast potential to the upper limit (700 V in this example), the desired density is not reached and the image contrast is kept at the upper limit, and as a result, the carrier development occurs.

Figures 2, 3:
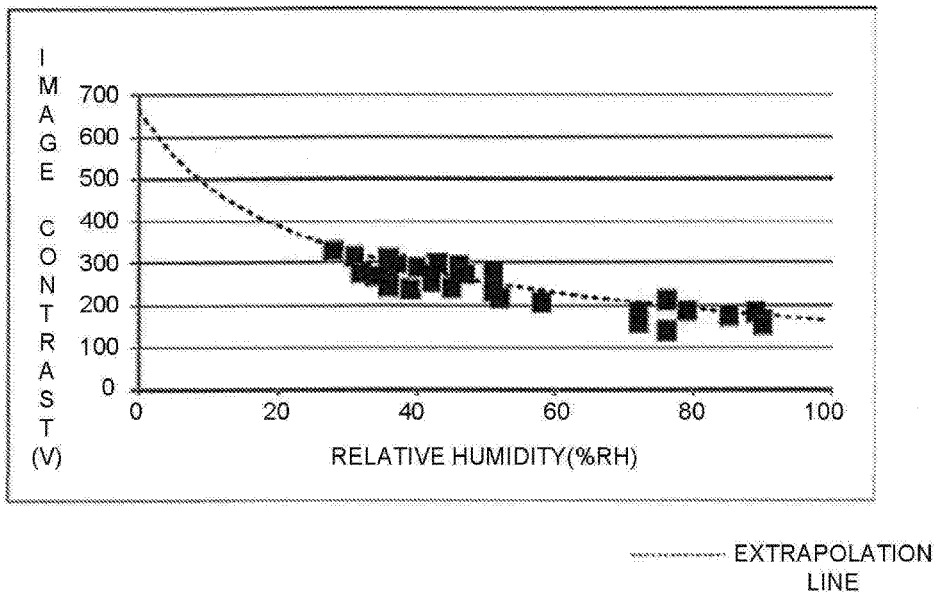
FIG. 2 is a diagram illustrating a control value of a limit of an image contrast potential on the basis of a thermistor detection temperature and a relative humidity inside the image forming apparatus.
FIG. 3 is a diagram illustrating a relationship between the relative humidity inside the image forming apparatus and a developing contrast potential capable of obtaining proper toner adhesion amount.

The conventional image forming apparatus sets an upper limit of the image contrast potential to 700 V in any environment. In the present embodiment, on the basis of the above study, as shown in FIG. 2, according to detected temperature and detected humidity, a control for changing the upper limit of the image contrast potential from 700 V to 350 V is adopted. By reducing the limit of the image contrast potential to a low order, the occurrence of the carrier development can be suppressed.

In the present example, the detected temperature by the temperature sensor 401 (thermistor detected temperature in the apparatus in FIG. 2) sets 42 degrees centigrade as a threshold value (first temperature threshold value), and is divided into two parts, that is, smaller than 42 degrees centigrade and equal to or greater than 42 degrees centigrade. The detected humidity of the humidity sensor 402 (relative humidity in the apparatus in FIG. 2) is divided into first division~fifth division according to the value thereof. In the present example, as shown in FIG. 2, the detected humidity sets a range smaller than 20% RH as a first division, and a range equal to or greater than 20% RH and smaller than 35% RH as a second division. The detected humidity sets a range equal to or greater than 35% RH and smaller than 55% RH as a third division, and a range equal to or greater than 55% RH (first humidity threshold value) and smaller than 75% RH as a fourth division. Further, the detected humidity sets a range equal to or greater than 75% RH (second humidity threshold value) to a fifth division.

As a point specified in FIG. 2, in the fourth division, that is, a range equal to or greater than 55% RH and smaller than 75% RH, in a range smaller than 42 degrees centigrade and a range equal to or greater than 42 degrees centigrade, the limits of the image contrast potential are 700 V and 350 V, which are different. In a case of the range smaller than 42 degrees centigrade, the limit of the image contrast potential is set to 700 V, and in a case of the range equal to or greater than 42 degrees centigrade, the limit of the image contrast potential is set to 350 V.

In a situation in which the detected temperature by the temperature sensor 401 is equal to or greater than 42 degrees centigrade, in a case in which the detected humidity is smaller than 55% RH, in other words, in the first~third divisions, the limit of the image contrast potential is set to 700 V. In a situation in which the detected temperature by the temperature sensor 401 is equal to or greater than 42 degrees centigrade, in a case in which the detected humidity is equal to or greater than 55% RH, in other words, in the fourth~fifth divisions, the limit of the image contrast potential is set to 350 V.

For another view on FIG. 2, in a case in which both the detected humidity and the detected temperature are equal to or greater than the threshold values thereof by comparing the detected humidity by the humidity sensor 402 with 55% RH (first humidity threshold value) and the detected temperature by the temperature sensor 401 with 42 degrees centigrade (first temperature threshold value), the upper limit value is set to 350 V. In a case in which the detected humidity is equal to or greater than 75% RH by comparing the detected humidity by the humidity sensor 402 with 75% RH (second humidity threshold value), regardless of the value of the detected temperature, the upper limit value is set to 350 V.

The upper limit values (700 V and 350 V) for switching and the numeric data shown in FIG. 2 are stored in the memory 802 in a nonvolatile manner according to data structure that is previously defined. The controller 800 carries out various control by using the upper limit values (700 V and 350 V) for switching and the numeric data shown in FIG. 2.

In a case of using the toner for low temperature fixing as in the present embodiment, as stated above, a plurality of the upper limits of the image contrast potential is set. The controller 800 determines whether or not the detected temperature and the detected relative humidity exceed the previously defined threshold values shown in FIG. 2 at the time of image formation, specifically, each time the density is adjusted. If the detected temperature and the detected relative humidity exceed the threshold values, the controller 800 switches to the upper limit of the image contrast potential to control the image contrast potential so as not to exceed the upper limit. By definition of the threshold values of the detected temperature and the detected relative humidity shown in FIG. 2 and the control, in the situations of the above first and third patterns, the upper limit of the image contrast potential is restricted to 350 V. In this way, by reducing the upper limit of the image contrast potential, as a result, the image contrast potential is prevented from reaching 700 V and the potential is reduced, and the carrier development can be suppressed.

With reference to FIG. 3, how to define the threshold value of the relative humidity is described. FIG. 3 is a diagram illustrating a relationship between the relative humidity and a developing contrast potential capable of obtaining proper toner adhesion amount. Generally, if the humidity is high, the adhesion amount is likely to increase, and thus, if the humidity is high, even if the developing contrast potential is restricted to be low, the adhesion amount becomes a proper toner density (toner adhesion amount). As shown in FIG. 3, if at least the relative humidity is equal to or greater than 50% RH, it is known that Vc of 350 V is sufficient, and the proper toner adhesion amount can be obtained. Thus, in the present example, at the time the relative humidity is equal to or greater than 55% RH, the upper limit of the image contrast potential is set to 350 V.

In FIG. 3, although an extrapolated value is indicated by a broken line, in a case in which the relative humidity is equal to or smaller than 20% RH, 350 V is not sufficient to obtain the proper toner adhesion amount. Thus, in the present embodiment, in a case in which at least the relative humidity is equal to smaller than a prescribed value (herein, 20% RH), the upper limit of the developing contrast potential is maintained at previous 700 V.

Figure 4:
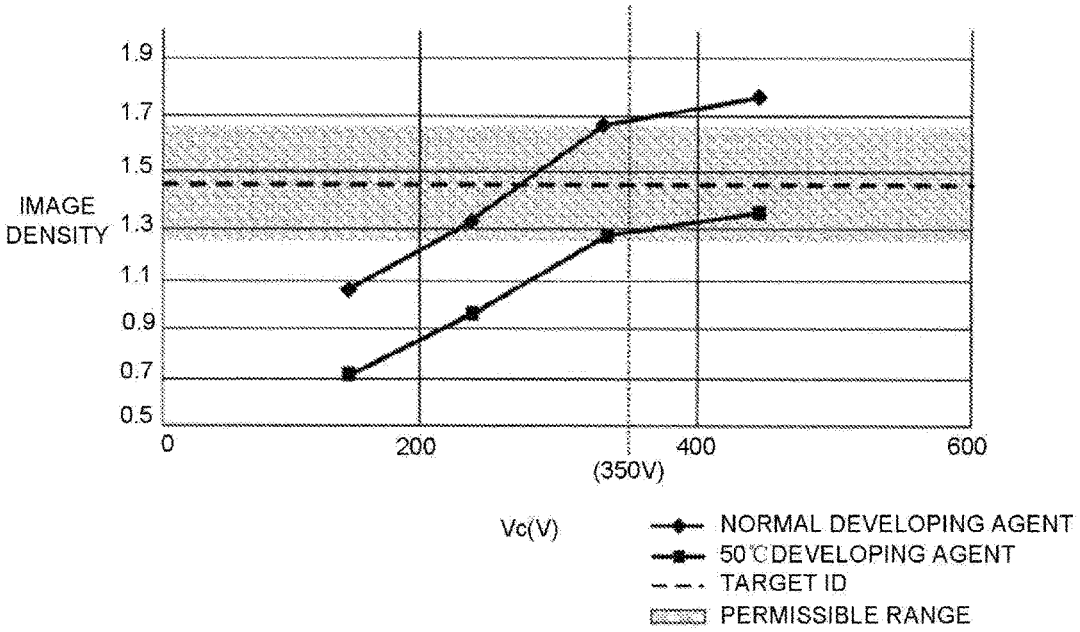
FIG. 4 is a diagram illustrating a relationship between an image density and the image contrast potential.

FIG. 4 is a diagram illustrating a relationship between an image density and an image contrast potential. Cyan is described as an example. The graph in which a measurement point shape is rhombus shows the relationship for the conventional toner and the graph in which the measurement point shape is a regular square shows the relationship for the toner for low temperature fixing. In this example, the 1.45 line of image density is set as a target value of cyan density, and about ±0.2 from the target value is set as the permissible range of the cyan density. In this example, as long as the cyan density can be kept within a range of 1.25~1.65, it is regarded that the image quality is satisfied.

As shown in FIG. 4, in a case in which the developing contrast potential is set to 350 V and the density value is also around 1.3, the permissible range of the density can be satisfied. Thus, by setting the upper limit of the developing contrast potential to 350 V, and by maintaining the potential at 350 V, it is possible to keep the image quality at an allowable value.

Each numeric value such as the threshold values shown above is merely an example, and depends on the type and the individual state of the image forming apparatus and the installation position of each sensor. In the embodiment, the low printing rate is smaller than 3% or equal to or smaller than 3%. The numeric value is also merely an example. In the embodiment, the detected humidity may be the humidity of the outside of the image forming apparatus 100, or the humidity of the inside of the image forming apparatus 100. Further, in the embodiment, it is desired that the temperature of the image forming unit is measured, and the temperature of the atmosphere of the outside may be measured.

In the above, the image contrast potential is described as an example of the development condition; however, the above embodiment can also be applied to the charging bias voltage, the exposure intensity and the like. In the case of the charging bias voltage, if the voltage value is increased, the toner adhesion amount is increased. For example, normally, VppAC=1200 V, but the same effect can be obtained by setting the upper limit value to 1400 V. The same is true for the exposure intensity, although 3.5 nJ/mm$^2$ is normal, by setting the upper limit to 5.0 nJ/mm$^2$, the same effect can be obtained.

The various data and data necessary for control are also stored in the memory 802. The controller 800 performs control using these data.

As described in detail above, according to the embodiment, it is possible to carry out printing with the image density within a permissible range while suppressing the occurrence of the carrier development even if the toner for low temperature fixing is used.

The present invention can be implemented in a variety of other forms without departing from the spirit or main characteristics of the invention. Therefore, the above embodiments are merely examples in all respects but not as limitations. The scope of the present invention is illustrated by the scope of the accompanying claims and is not limited to this specification. Furthermore, various improvements, substitutions and reforms belonging to the equivalent scope of the scope of the claims all fall within the scope of the present invention.

What is claimed is:

1. An image forming apparatus, comprising:

an image forming unit comprising a developing device for developing an image with a two-component developing agent to form the image;

a toner cartridge configured to supply toner having a glass transition temperature of about 50 degrees centigrade or lower to the developing device;

a humidity detector configured to detect humidity of an inside or outside of the image forming apparatus;

a temperature detector configured to detect temperature of an inside or in a vicinity of outside of the image forming unit; and a controller configured to compare a temperature value detected by the temperature detector with a first temperature threshold value previously set and compare a humidity value detected by the humidity detector with a first humidity threshold value previously set; and switch an upper limit value of a first development condition which is one of development conditions from a first value to a second value smaller than the first value to carry out control to form the image so that the upper limit value of the first development condition is less than or equal to the second value when both the temperature value and the humidity value are greater than or equal to the threshold values thereof.

2. The image forming apparatus according to claim 1, wherein the controller further compares a humidity value detected by the humidity detector with a second humidity threshold value higher than the first humidity threshold value; when the humidity value is higher than the second humidity threshold value, regardless of a result of comparison between the temperature value and the first temperature threshold value, the controller switches the upper limit value of the first development condition from the first value to the second value to carry out control to form the image so that the upper limit value of the first development condition is not more than the second value.

3. The image forming apparatus according to claim 2, wherein the controller maintains the upper limit value of the first development condition at the first value in a case in which the humidity value detected by the humidity detector is smaller than a prescribed value.

4. The image forming apparatus according to claim 1, wherein the controller maintains the upper limit value of the first development condition at the first value when the humidity value detected by the humidity detector is smaller than a prescribed value.

5. The image forming apparatus according to claim 1, wherein the controller sets a temperature higher than the glass transition temperature to the first temperature threshold value, and compares the temperature value detected by the temperature detector with the first temperature threshold value.

6. The image forming apparatus according to claim 1, wherein the controller sets the developing contrast potential as the first development condition, and carries out control to execute switching and image formation.

7. The image forming apparatus according to claim 1, wherein the toner supplied to the developing device has a glass transition temperature of about 45 degrees centigrade or lower.

8. A low temperature fixing image forming apparatus, comprising:

an image forming unit comprising a developing device for developing an image with a two-component developing agent for low temperature fixing to form the image;

a toner cartridge configured to supply toner having a glass transition temperature of about 50 degrees centigrade or lower to the developing device;

a humidity detector configured to detect humidity of an inside or outside of the image forming apparatus;

a temperature detector configured to detect temperature of an inside or in a vicinity of outside of the image forming unit; and a controller configured to compare a temperature value detected by the temperature detector with a first temperature threshold value previously set and compare a humidity value detected by the humidity detector with a first humidity threshold value previously set; and switch an upper limit value of a first development condition which is one of development conditions from a first value to a second value smaller than the first value to carry out control to form the image so that the upper limit value of the first development condition is less than or equal to the second value when both the temperature value and the humidity value are greater than or equal to the threshold values thereof.

9. The low temperature fixing image forming apparatus according to claim 8, wherein the controller further compares a humidity value detected by the humidity detector with a second humidity threshold value higher than the first humidity threshold value; when the humidity value is higher than the second humidity threshold value, regardless of a result of comparison between the temperature value and the first temperature threshold value, the controller switches the upper limit value of the first development condition from the first value to the second value to carry out control to form the image so that the upper limit value of the first development condition is not more than the second value.

10. The low temperature fixing image forming apparatus according to claim 8, wherein the controller maintains the upper limit value of the first development condition at the first value when the humidity value detected by the humidity detector is smaller than a prescribed value.

11. The low temperature fixing image forming apparatus according to claim 8, wherein the controller sets a temperature higher than the glass transition temperature to the first temperature threshold value, and compares the temperature value detected by the temperature detector with the first temperature threshold value.

12. The low temperature fixing image forming apparatus according to claim 8, wherein the controller sets the developing contrast potential as the first development condition, and carries out control to execute switching and image formation.

13. The low temperature fixing image forming apparatus according to claim 8, wherein the toner supplied to the developing device has a glass transition temperature of about 45 degrees centigrade or lower.

14. An image forming method, comprising:

supplying toner having a glass transition temperature of about 50 degrees centigrade or lower to a developing device in an image forming apparatus;

detecting humidity of an inside or outside of the image forming apparatus;

detecting temperature of an inside or in a vicinity of outside of the image forming unit;

developing an image with a two-component developing agent to form the image;

comparing a temperature value detected with a first temperature threshold value previously set and comparing a humidity value detected with a first humidity threshold value previously set; and switching an upper limit value of a first development condition which is one of development conditions from a first value to a second value smaller than the first value to carry out control to form the image so that the upper limit value of the first development condition is less than or equal to the second value when both the temperature value and the humidity value are greater than or equal to the threshold values thereof.

15. The image forming method according to claim 14, further comprising:

comparing a humidity value detected with a second humidity threshold value higher than the first humidity threshold value; when the humidity value is higher than the second humidity threshold value, regardless of a result of comparison between the temperature value and the first temperature threshold value, switching the upper limit value of the first development condition from the first value to the second value to form the image so that the upper limit value of the first development condition is not more than the second value.

16. The image forming method according to claim 15, further comprising:

maintaining the upper limit value of the first development condition at the first value in a case in which the humidity value is smaller than a prescribed value.

17. The image forming method according to claim 14, further comprising:

maintaining the upper limit value of the first development condition at the first value when the humidity value detected is smaller than a prescribed value.

18. The image forming method according to claim 14, further comprising:

setting a temperature higher than the glass transition temperature to the first temperature threshold value, and comparing the temperature value detected with the first temperature threshold value.

19. The image forming method according to claim 14, further comprising:

setting the developing contrast potential as the first development condition, and carrying out control to execute switching and image forming.

20. The image forming method according to claim 14, wherein the toner supplied to the developing device has a glass transition temperature of about 45 degrees centigrade or lower.

* * * * *